US008250678B2

(12) United States Patent
Sup

(10) Patent No.: US 8,250,678 B2
(45) Date of Patent: Aug. 28, 2012

(54) SWIM GOGGLE

(75) Inventor: Ha Heang Sup, Shenzhen (CN)

(73) Assignee: Tian Hui Silicone (Shenzhen) Co., Ltd., Shenzhen, Guangdong (CN)

( * ) Notice: Subject to any disclaimer, the term of this patent is extended or adjusted under 35 U.S.C. 154(b) by 227 days.

(21) Appl. No.: 12/800,616

(22) Filed: May 18, 2010

(65) Prior Publication Data

US 2011/0131712 A1 Jun. 9, 2011

(30) Foreign Application Priority Data

Dec. 8, 2009 (CN) ..... 2009 2 0261224 U

(51) Int. Cl.
*A61F 9/02* (2006.01)

(52) U.S. Cl. ..... 2/440; 2/442; 2/445; 2/452

(58) Field of Classification Search ..... 2/439–446, 2/452

See application file for complete search history.

(56) References Cited

U.S. PATENT DOCUMENTS 5,642,178 A * 6/1997 Leonardi et al. ..... 351/111
6,253,387 B1 * 7/2001 Yu ..... 2/428
6,721,963 B1 * 4/2004 Kawashima ..... 2/426
6,969,172 B2 * 11/2005 Actis-Datta ..... 351/86
7,143,454 B2 * 12/2006 Kawashima et al. ..... 2/440
7,891,024 B2 * 2/2011 Garofalo et al. ..... 2/426
7,900,280 B2 * 3/2011 Thorpe et al. ..... 2/428
7,992,227 B2 * 8/2011 Shiue ..... 2/445
8,051,502 B2 * 11/2011 Chiang ..... 2/448
2005/0120468 A1 * 6/2005 Kawashima et al. ..... 2/444

* cited by examiner

*Primary Examiner* — Danny Worrell
(74) *Attorney, Agent, or Firm* — Raymond Y. Chan; David and Raymond Patent Firm

(57) ABSTRACT

A protective eyewear includes a bridge unit, two lens rims, and two sealing gaskets as the major functional components which are made of different silicone materials with different degrees of hardness, and are integrally bonded together to form an integrated goggle frame. The functional components are made of different types of silicone materials as long as they are soft and flexible. Each functional component has a preset hardness determined by the type of silicone material being used, to achieve the different purposes of use for different activities, such as competition or general swimming activity. The functional components are also made into different color to provide aesthetic effect. In additional, the manufacture method not only provides manufacturing different functional components for enabling mix and match design but also facilitates the goggle frame for mass production.

8 Claims, 2 Drawing Sheets

SWIM GOGGLE

BACKGROUND OF THE PRESENT INVENTION

1. Field of Invention

The present invention relates to an eyewear, and more particularly to a protective eyewear such as a swim goggle for swimming or diving in shallow water.

2. Description of Related Arts

A conventional one piece silicone swim goggle usually utilizes one type of silicone for one component of the swim goggle of which the hardness is fixed at one level. There is no differential hardness and color for one single component of the silicone swim goggle. In particular, the swim goggle fails to provide different hardness requirements at different positions of the goggle frame corresponding to different technical effects and functions of the swim goggle. In other words, each component of the goggle frame will have the same hardness. At present, the silicone swim goggle sold in the market is a unibody goggle and generally comprises two lens holders and a bridge integrally extending therebetween, wherein the bridge is made of relatively harder silicone in comparison with the lens holders. However, it is difficult to control the position of the hardness of the bridge at the center of the goggle and it is also disadvantageous in that the appearance will be unaesthetic.

SUMMARY OF THE PRESENT INVENTION

The invention is advantageous in that it provides a silicone frame for protective eyewear especially for swimming or diving which solves the problem of different hardness requirements at different positions of the protective eyewear so as to achieve different functional requirements at different positions.

Another advantage of the invention is to provide a silicone frame for protective eyewear which comprises two or more functional components for providing different hardness requirements for different portions of the goggle frame. Therefore, differentiated hardness for providing comfortable and water tight sealing gasket which is the softest, a relatively harder lens rim and the hardest bridge unit can all be included in a one-piece goggle frame.

Another advantage of the invention is to provide a method of manufacture of goggle frame for protective eyewear which facilitates mass production.

Additional advantages and features of the invention will become apparent from the description which follows, and may be realized by means of the instrumentalities and combinations particular point out in the appended claims.

According to the present invention, the foregoing and other objects and advantages are attained by a protective eyewear for swimming or shallow water diving, comprising:

a bridge unit made of a first silicone material;

two lens rims made of a second silicone material, wherein two ends of the bridge unit are integrally extended between the inner sides of the lens rims; and two sealing gaskets made of a third silicone material, coupling with the two lens rims respectively to form two lens frames for holding two lenses in position.

Accordingly, the first, second and third silicone materials are soft and resilient silicone materials having different degrees of hardness.

Preferably, the bridge unit, the two lens rims and the two sealing gaskets are integrally bonded to form a one-piece goggle frame.

Preferably, the bridge unit, the two lens rims and the two sealing gaskets are of different color.

Preferably, the first, the second and the third silicone materials consists of a combination of colored silicone material and transparent silicone material.

In particular, the goggle frame further defines three major functional components, wherein the bridge unit is defined as a first silicone body, the lens rim is defined as a second silicone body and the sealing gasket is defined as a third silicone body, wherein the three silicone bodies have different degree of hardness in which the first silicone body has the highest degree of hardness and the third silicone body has the lowest degree of hardness when compared amongst the three silicone bodies.

Preferably, the silicone frame further comprises a fourth functional component which are two lens straps made of a fourth silicone materials as a fourth silicone body, wherein an inner end of each of the lens straps is extended from the outer side of the respective lens rim to integrally bond therewith so as to form a one-piece goggle frame.

Preferably, the goggle frame further comprises a fifth functional component which is a connecting strap made of a fifth silicone material as a fifth silicone body, two ends of the connecting strap are connected to the outer ends of the lens straps respectively to integrally bond therewith so as to form a one-piece goggle frame.

The connecting strap is preferably an elongated body defining an oval through hole longitudinally in a middle portion of the body for providing flexibility for stretching.

Accordingly, the goggle frame of the present invention preferably made by two to five functional components with different hardness levels.

In comparison with the conventional on-piece goggle, the present invention provides different functional components made of different types of silicone with different physical properties, such that the functional components have different hardness levels. Therefore, the protective eyewear requiring different functional requirements of hardness or softness for the functional components can be achieved through the present invention. In addition, the present invention further provides flexibility in the choice of color and transparency level for each type of functional components respectively, and enhances the aesthetic appearance of the protective eyewear.

Still further objects and advantages will become apparent from a consideration of the ensuing description and drawings.

These and other objectives, features, and advantages of the present invention will become apparent from the following detailed description, the accompanying drawings, and the appended claims.

BRIEF DESCRIPTION OF THE DRAWINGS

FIG. 1-2 is a top view of a protective eyewear according to the preferred embodiment of the present invention.

FIG. 2 is an illustration of a protective eyewear according to a first illustrative example of the preferred embodiment of the present invention.

DETAILED DESCRIPTION OF THE PREFERRED EMBODIMENT

Figure 1:
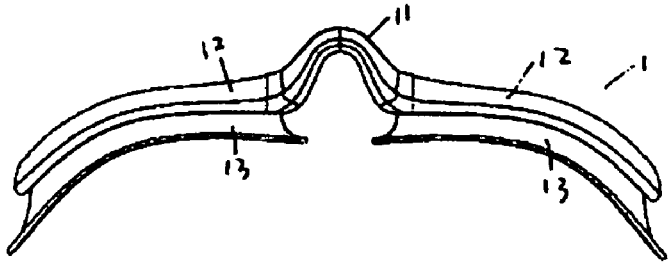
FIG. 1-1 is a front view of a protective eyewear according to a preferred embodiment of the present invention.
Figures 1, 2:
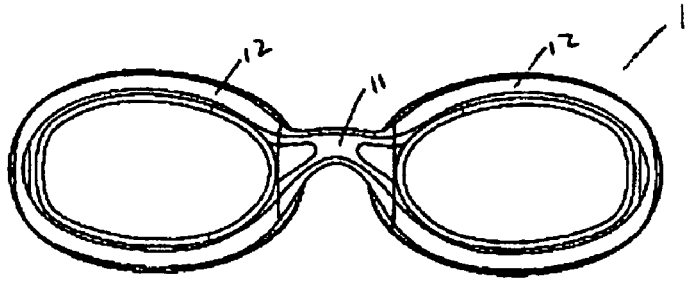
Figure 2:
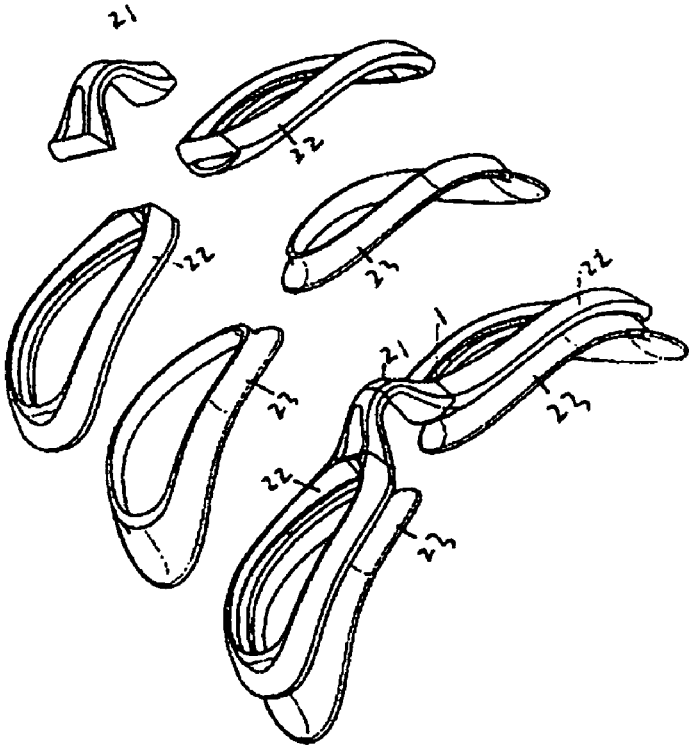

Referring to FIGS. 1-1 and 1-2 of the drawings, a protective eyewear with improved structure, especially for swimming or diving, according to a preferred embodiment of the present invention is illustrated. The protective eyewear comprises a goggle frame 1 which comprises two lens frames for retaining two lenses in position respectively, and a bridge unit 11 extending between two inner sides of the lens frames. It is appreciated that each lens frame can retain a single or double layered lens therearound. Each of the lens frames comprises a lens rim 12 encircling with the respective lens and a sealing gasket 13 rearwardly and circumferentially extended from the lens rim 12 for sealing and resting against the face of the wearer for eye protection. Preferably, the lens rim 12 has an oval shape circumferentially encircling with the respective lens that the bridge unit 11 is extended between the inner sides of the lens rims 12. The bridge unit 11, the lens rim 12, and the sealing gasket 13 are made of silicone with different hardness levels. In other words, the bridge unit 11, the lens rim 12, and the sealing gasket 13 have their own hardness. Preferably, the sealing gasket 13 is integrally coupled with the respective lens rim 12 by adhesive to form a one piece lens frame structure. The two outer ends of the bridge unit 11 are integrally coupled with the lens frames by adhesive to form a one piece goggle frame structure. Therefore, the different components of the goggle frame 1 are made of different types of silicone materials which are generally soft and flexible. In particular, each component of the goggle frame 1 has a predetermined degree of hardness of which is determined by the type of silicone materials being used, depending on the purposes of use of the protective eyewear for different activities, such as competition or general swimming activities.

Referring to FIG. 2 of the drawings, a protective eyewear especially for swimming according to a first illustrative example of the preferred embodiment is illustrated. The goggle frame 1 of the protective eyewear comprises three functional components which are the bridge unit 21, the lens rim 22, and the sealing gasket 23. The bridge unit 21 is embodied as a first silicone body which has the highest level of hardness comparing to the lens rim 22 and the sealing gasket 23. The size of the cross-section of the bridge unit 21 can be selectively formed with respect to the flexibility of the material of the bridge unit 21. The two lens rims 22, which are the left and right lens rims formed in oval shape, are embodied as the second silicone body. The two sealing gaskets 23 are embodied as the third silicone body. The third silicone body is made of softer material comparing with the first and second silica bodies. Therefore, the hardness level of the bridge unit 21 is higher than the hardness level of the lens rim 22 which is higher than the hardness level of the sealing gasket 23. The thickness of the sealing gasket 23 can be selectively set based on a flexibility of the silicone materials being used.

The three functional components of the goggle frame 1 are integrally coupled together by adhesive to form a one-piece frame body. In other words, the bridge unit 21, the two lens rims 22 and the two sealing gaskets 23 are integrated together to form the goggle frame 1 in a one-piece unit. Furthermore, the different functional components may have different colors through applying different colors externally to or by using different colored silicone materials for the functional components. Accordingly, to enhance an appearance and underscore the features of the goggle frame 1, different color combinations for different functional components can be used. For example, the goggle frame 1 can be integrally formed by silicone materials of different color and transparency levels in such a manner that the bridge unit 21, the two lens rims 22 and the two sealing gaskets 23 can have three different colors and different transparency levels respectively.

Figure 3:
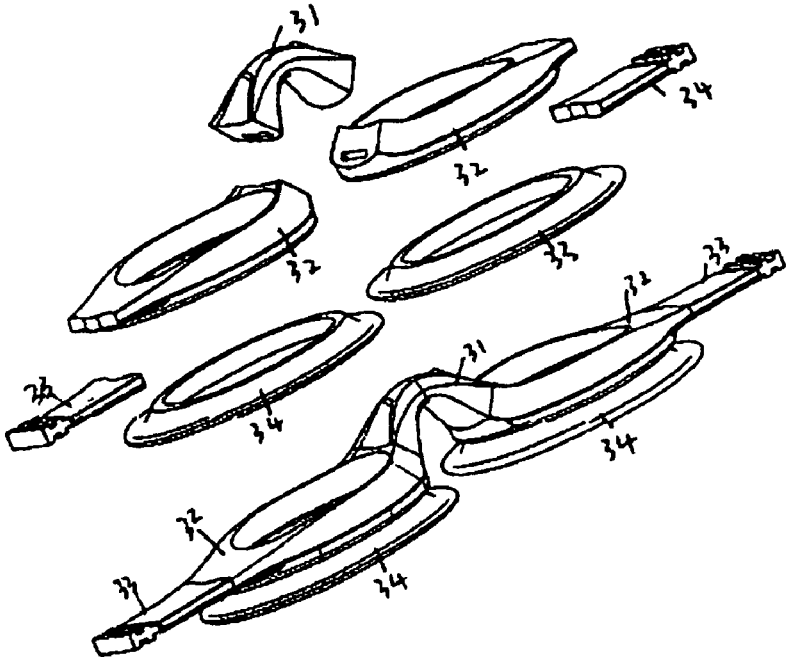
FIG. 3 is an illustration of a protective eyewear according to a second illustrative example of the preferred embodiment of the present invention.

Referring to FIG. 3 of the drawings, a protective eyewear for swimming according to a second illustrative example of the preferred embodiment of the present invention is illustrated. The goggle frame 1 of the protective eyewear comprises four functional components. The bridge unit 31 is embodied as a first silicone body. The two lens rims 32, which are the left and right lens rims formed in oval shape, are embodied as the second silicone body. The two sealing gaskets 33 are embodied as the third silicone body. The goggle frame 1 further comprises two lens straps 34 integrally extended from two outer sides of the lens frames respectively, wherein the lens straps 34 are embodied as the fourth silica body. Accordingly, the lens straps 34 are integrally coupled with two outer sides of the lens rims 32 respectively, wherein the four functional components have different hardness levels.

Figure 4:
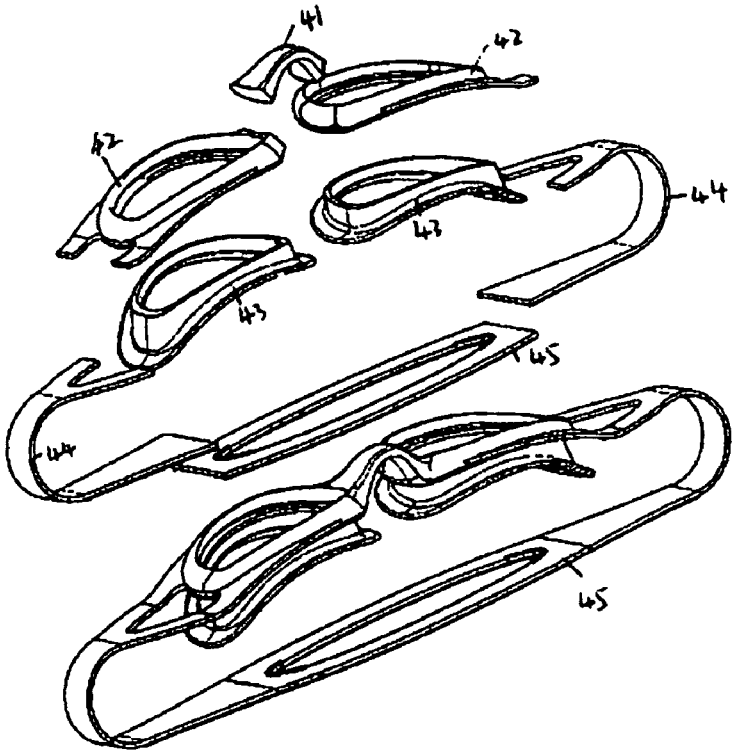
FIG. 4 is an illustration of a protective eyewear according to a third illustrative example of the preferred embodiment of the present invention.

Referring to FIG. 4 of the drawings, a silicone frame for framing a protective eyewear for swimming according to a third illustrative example of the preferred embodiment is illustrated. The goggle frame 1 of the protective eyewear comprises five functional components. The bridge unit 41 is embodied as a first silicone body. The two lens rims 42, which are the left and right lens rims formed in oval shape, are embodied as the second silicone body. The two sealing gaskets 43 are embodied as the third silicone body. The lens straps 44 are embodied as the fourth silicone body. The goggle frame 1 further comprises a connecting strap 45 integrally extended from two free ends of the lens straps 44 respectively, wherein the connecting strap 45 is embodied as the fifth silica body. Accordingly, the connecting strap 45 is preferably an elongated body defining an oval through hole longitudinally in a middle portion of the body for providing flexibility for stretching, wherein the five functional components have different hardness levels.

According to the present invention, the protective eyewear is manufactured by the method comprising the steps of manufacturing each of the functional components with a predetermined size and shape and a preset silicone material such that each of the functional components has its own hardness level; and coupling the functional components together by adhesive such that the functional components are integrally bonded with each other to form an integrated one-piece eyewear structure. Since the functional components are made of different types of silicone which have different physical properties respectively, the functional components have different hardness levels. Therefore, the protective eyewear requiring different functional requirements of hardness or softness for the functional components can be achieved through the present invention. In addition, the present invention further provides flexibility in the choice of color and transparency level for each type of functional components respectively. Accordingly, the present invention not only provides improvement in relation to comfort, but also greatly enhances the possibility of design for improved aesthetic and outlook for marketing.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A protective eyewear, comprising:

a bridge unit made of a first silicone material as a first silicone body;

two lens frames, wherein said bridge unit is integrally extended from two inner sides of said lens frames to form a one-piece integrated goggle frame for holding two lenses in position, wherein each of said lens frames comprises a lens rim made of a second silicone material as a second silicone body and a sealing gasket integrally extended from said lens rim and made of a third silicone material as a third silicone body, wherein said first, second and third silicone materials have different degrees of hardness, such that said goggle frame has different hardness levels at different positions thereof;

two lens straps integrally extended from two outer sides of said lens frames respectively, wherein each of said lens straps is made of a fourth silicone material as a fourth silicone body that said first, second, third, and fourth silicone materials have different degrees of hardness; and a connecting strap integrally extended from two outer ends of said lens straps respectively, wherein said connecting strap is an elongated body defining an oval through hole longitudinally in a middle portion of said body for providing flexibility for stretching, wherein said connecting strap is made of a fifth silicone material as a fifth silicone body that said first, second, third, fourth, and fifth silicone materials have different degrees of hardness.

2. The protective eyewear, as recited in claim 1, wherein said first, second, third, fourth, and fifth silicone bodies are integrally bonded with together correspondingly by adhesive to form said integrated goggle frame.

3. The protective eyewear, as recited in claim 2, wherein said first, second, third, fourth, and fifth silicone bodies have different colors and transparency levels.

4. A method of manufacturing a protective eyewear, comprising the steps of:

(a) manufacturing a plurality of functional components with different silicone materials such that said functional components have different degrees of hardness; and (b) integrally bonding said functional components with together to form an integrated goggle frame, such that said goggle frame has different hardness levels at different positions thereof;

wherein the step (a) further comprises a step of manufacturing a bridge unit, two lens rims, and two sealing gaskets as said functional components respectively, wherein said bridge unit, said lens rims, and said sealing gaskets are made of first, second, and third silicone materials as first, second, and third silicone bodies respectively, wherein said first, second and third silicone bodies have different degrees of hardness;

wherein said bridge unit is harder than said lens rim which is harder than said sealing gasket;

wherein the step (a) further comprises a step of manufacturing two lens straps made of a fourth silicone material as a fourth silicone body, wherein said first, second, third, and fourth silicone materials have different degrees of hardness;

wherein the step (a) further comprises a step of manufacturing a connecting strap made of a fifth silicone material as a fifth silicone body, wherein said first, second, third, fourth, and fifth silicone materials have different degrees of hardness.

5. The method as recited in claim 4 wherein, in the step (b), said first, second, third, fourth, and fifth silicone bodies are integrally bonded with together correspondingly by adhesive to form said integrated goggle frame.

6. The method as recited in claim 5 wherein, in the step (a), said first, second, third, fourth, and fifth silicone bodies have different colors and transparency levels.

7. A protective eyewear, comprising:

a bridge unit made of a first silicone material as a first silicone body;

two lens frames, wherein said bridge unit is integrally extended from two inner sides of said lens frames to form a one-piece integrated goggle frame for holding two lenses in position, wherein each of said lens frames comprises a lens rim made of a second silicone material as a second silicone body and a sealing gasket integrally extended from said lens rim and made of a third silicone material as a third silicone body, wherein said first, second and third silicone materials have different degrees of hardness, such that said goggle frame has different hardness levels at different positions thereof, two lens straps integrally extended from two outer sides of said lens frames respectively, wherein each of said lens straps is made of a fourth silicone material as a fourth silicone body that said first, second, third, and fourth silicone materials have different degrees of hardness; and a connecting strap integrally extended from two outer ends of said lens straps respectively, wherein said connecting strap is an elongated body defining an oval through hole longitudinally in a middle portion of said body for providing flexibility for stretching, wherein said connecting strap is made of a fifth silicone material as a fifth silicone body that said first, second, third, fourth, and fifth silicone materials have different degrees of hardness;

wherein said bridge unit is harder than said lens rim which is harder than said sealing gasket;

wherein said bridge unit is integrally bonded between said lens rims while said sealing gaskets are integrally bonded to said lens rims respectively to form said integrated goggle frame.

8. The protective eyewear, as recited in claim 7, wherein said first, second, third, fourth, and fifth silicone bodies are integrally bonded with together correspondingly by adhesive to form said integrated goggle frame.

* * * * *